US007232254B2

(12) United States Patent
Forsey et al.

(10) Patent No.: US 7,232,254 B2
(45) Date of Patent: Jun. 19, 2007

(54) CHRONOGRAPH-TYPE WATCH

(75) Inventors: Stephen Edward Methuen Forsey, Le Locle (CH); Robert Greubel, La Neuveville (CH)

(73) Assignees: Vaucher Manufacture Fleurier S.A (CH), part interest; Complitime S.A. (CH), part interest ( * ) Notice: Subject to any disclaimer, the term of this patent is extended or adjusted under 35 U.S.C. 154(b) by 275 days.

(21) Appl. No.: 10/528,299

(22) PCT Filed: Dec. 2, 2002

(86) PCT No.: PCT/IB02/05054

§ 371 (c)(1),
(2), (4) Date: Mar. 16, 2005

(87) PCT Pub. No.: WO2004/031290

PCT Pub. Date: Apr. 15, 2004

(65) Prior Publication Data

US 2006/0164922 A1 Jul. 27, 2006

(30) Foreign Application Priority Data

Oct. 7, 2002 (EP) ..... 02022505

(51) Int. Cl.
*G04F 7/00* (2006.01)
*G04F 8/00* (2006.01)

(52) U.S. Cl. ..... 368/101; 368/110

(58) Field of Classification Search ..... 368/101–107, 368/110–113, 308, 319–321
See application file for complete search history.

(56) References Cited

U.S. PATENT DOCUMENTS

| | | | | |
|---|---|---|---|---|
| 6,200,019 | B1 * | 3/2001 | Latini | 368/289 |
| 6,466,518 | B1 * | 10/2002 | Akahane et al. | 368/64 |
| 6,679,624 | B1 * | 1/2004 | Mouawad | 368/216 |
| 6,975,561 | B2 * | 12/2005 | Forsey et al. | 368/10 |
| 2001/0043512 | A1 * | 11/2001 | Igarashi et al. | 368/204 |

FOREIGN PATENT DOCUMENTS

| | | |
|---|---|---|
| CH | 104 374 | 5/1923 |
| CH | 585 431 | 2/1977 |
| JP | 11 194182 | 7/1999 |

* cited by examiner

*Primary Examiner*—Vit W. Miska
(74) *Attorney, Agent, or Firm*—McGlew and Tuttle P.C

(57) ABSTRACT

The invention concerns a chronograph-type watch provided with a movement (29) comprising: current time display means, measured time display means, a time base designed to regulate said display means, a control device (34, 40) for starting and stopping the measured time display means, a reset device for resetting the measured time display means when time measurement is over. The watch is provided with a case (10) for housing the movement (29) and comprising at least one slide (24) for controlling the control and reset devices. Said watch further comprises a locking device (32, 52) designed to co-operate with the control device (34, 40) to enable or disable it, and an actuating member (28, 44) designed to de accessible outside the case (10), for controlling device locking device (32, 52).

9 Claims, 5 Drawing Sheets

Fig.3
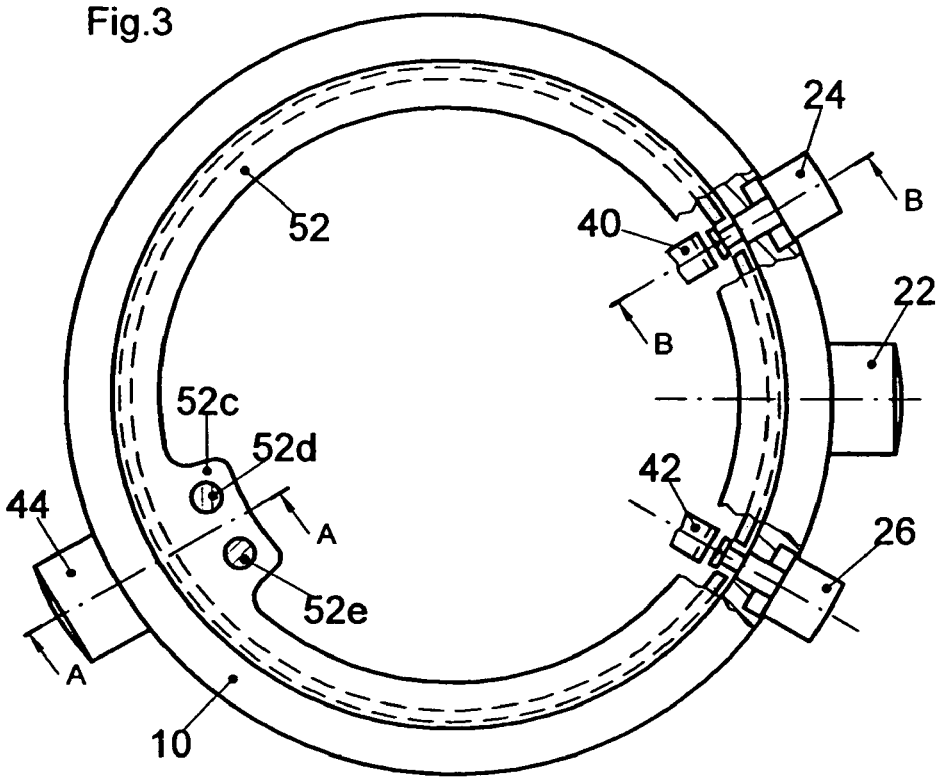
Fig.3a
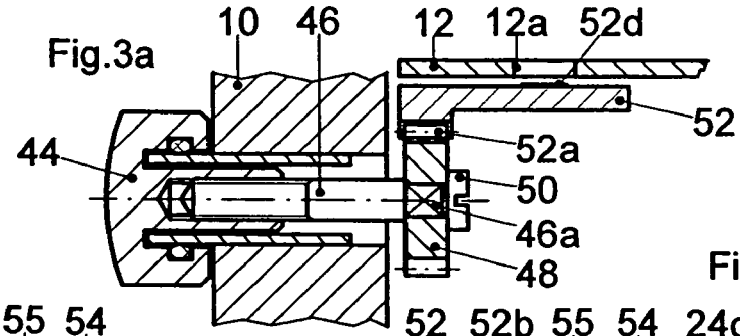
Fig.3b1
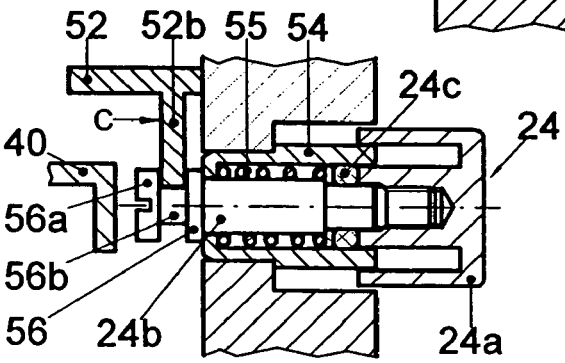
Fig.3b2
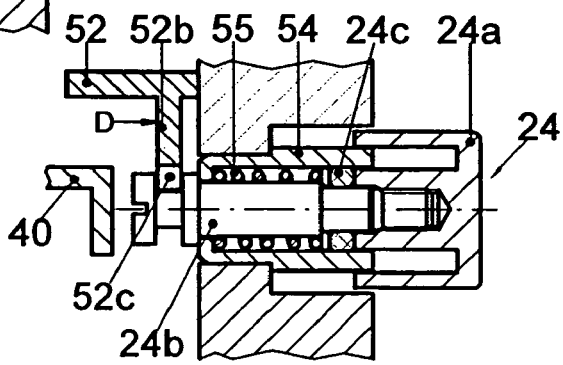
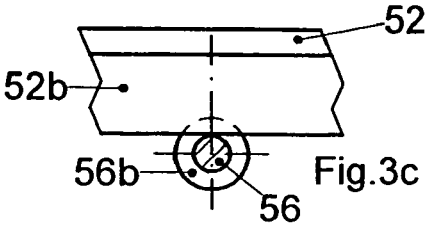
Fig.3c
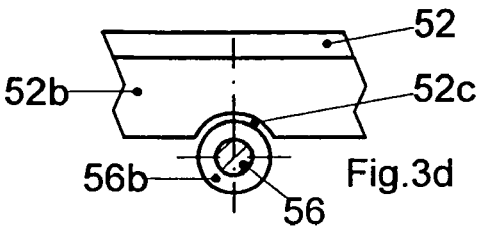
Fig.3d Fig.4
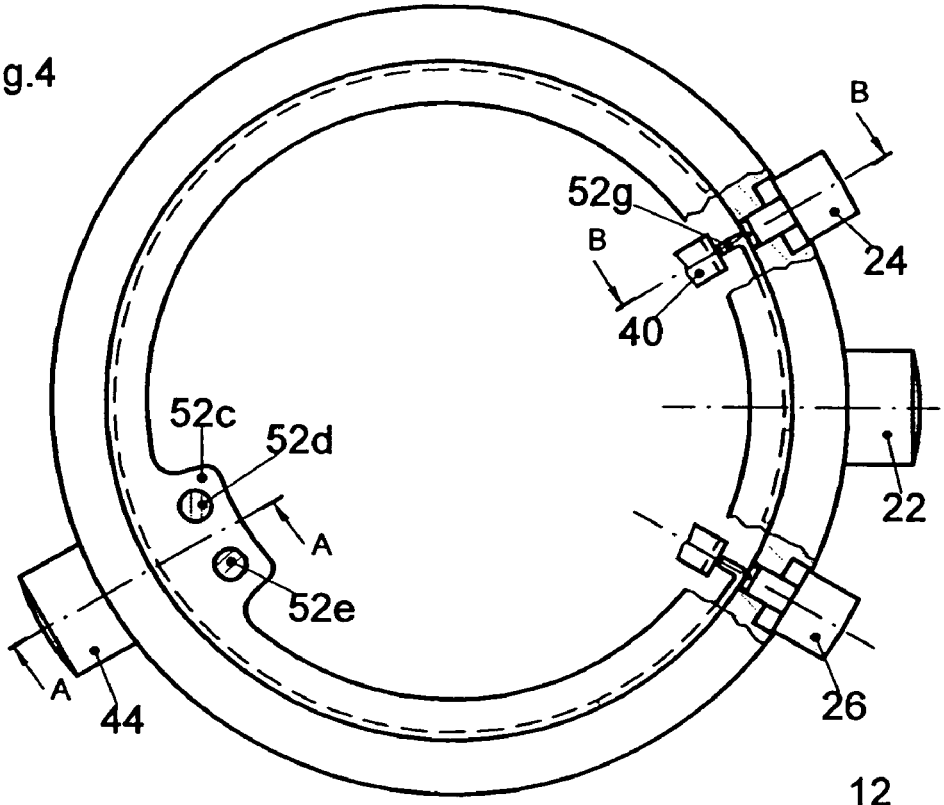
Fig.4a
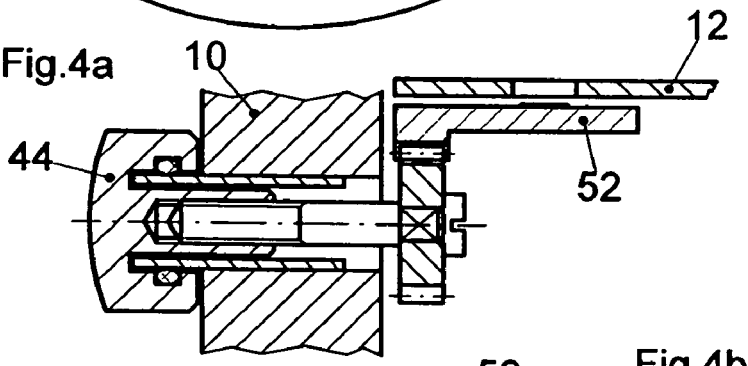
Fig.4b1
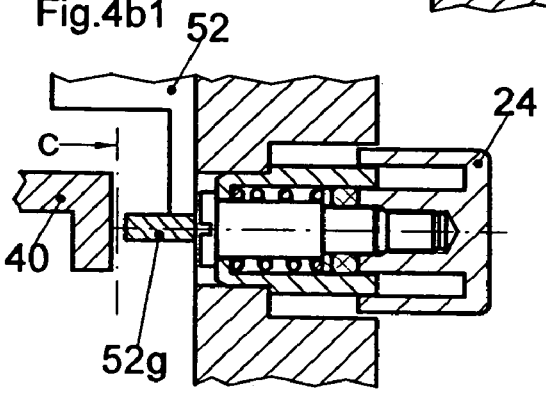
Fig.4b2
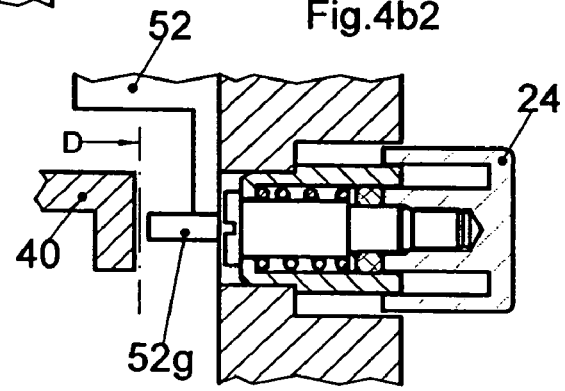
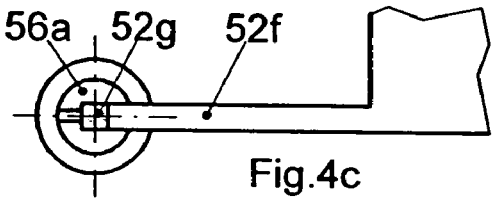
Fig.4c
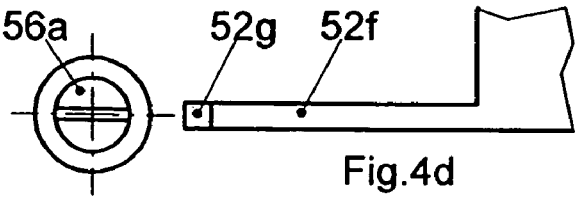
Fig.4d

CHRONOGRAPH-TYPE WATCH

BACKGROUND OF THE INVENTION

The present invention concerns chronograph-type watches. Such watches allow a period of time to be measured from a given moment, control being carried out by an application of pressure on one or more push-buttons. It relates more specifically to a watch provided with a movement comprising:

current time display means, measured time display means, a time base arranged for adjusting both the current time and measured time display means, a control device for starting and stopping the measured time display means, and a reset device for resetting the measured time display means when a measurement is finished.

This watch further comprises a case acting as a housing for the movement and including at least one push-button for controlling the control and reset devices. Some of these watches comprise only one push-button for controlling both devices, others, more commonly, comprise two distinct push-buttons.

Such watches are liable to inadvertent manoeuvres. Thus, a shock on one of the push-buttons can suddenly stop a measurement that is being carried out. Such a situation can also occurring during diving, when the water pressure acts on the start-stop push-button and can interrupt a measurement that is being carried out, which may, at the very least, be detrimental.

Moreover, it is possible to make watches that comprise a single hand capable of displaying several pieces of information, like for example the minutes of the current time and the minutes of the measured time. One such watch is disclosed in EP Patent No. 02022505.8. In order to avoid any uncertainty as to the information being displayed, it is desirable for the passage from one function to another to occur clearly. This can be achieved by locking the chronograph mechanism while the hand with a dual display function is indicating information other than that relating to the measured time.

SUMMARY OF THE INVENTION

It is an object of the present invention to overcome these drawbacks. Thus, the watch according to the invention is characterized in that it further comprises a locking device, arranged for cooperating with the control device, and capable of occupying first and second positions in which the control device can or cannot be activated, and an activating member that can be accessed from outside the case to control the locking device. Owing to this locking device, it is thus possible to prevent any accidental manipulation.

Of course, chronograph-type watches are known wherein the push-buttons can be screwed onto the middle part, so as to improve water resistance. It is quite clear that a screwed-in push-button becomes inoperative. Such an operation requires however certain care, each push-button having to be locked by itself. If there is a control member accessible from the outside of the case, which controls the locking member, it is possible to lock the two push-buttons simultaneously. The control member can either be a push-button or a crown, depending upon the desired purpose.

When the measured time display means also allow other information to be displayed, it is desirable for the control device to be inactive while the measured time display means are displaying this other information. For this purpose, the locking device is arranged such that it can only act on the control device when the measured time display means are at zero or are displaying information other than the measured time. Consequently, while the measured time display means display information other than the measured time, any action on the control member, and thereby on the locking device, enables the control device and resets the dual display hand to zero. In this case, the control member is advantageously a push-button.

During some measurements, it is desirable to be able to keep the information until it can be noted down or used. In order to allow information to be saved, the locking device is designed so as to enable or disable the reset device.

The locking device advantageously comprises a locking part which acts on the push-button in order to immobilise it. Consequently, the push-button cannot be accidentally moved, either by a movement of the user, or by water pressure during a dive.

In a variant, the locking device includes a mobile connecting part arranged such that, depending upon the position that it occupies, an application on the push-button either is or is not transmitted to the control mechanism.

It is also possible to combine the presence of a mobile connecting part with locking the push-button. In this case, during the locking operation, the push-button can be moved, so as to place its sealing gasket under stress and thus reinforce water resistance.

In order to allow the user to know which state the chronograph mechanism is in, the locking device further includes a display member visible on the watch dial, for indicating the position occupied by the locking device, and consequently, whether or not the control device can be activated.

The activating member can be formed of a crown pivotably mounted on the case. It can also be formed of a push-button.

In a particularly simple embodiment, the locking device includes:

a stem arranged through the case and for carrying the crown comprised in the control member, and a pinion at its end inside the case, a ring surrounding the movement and provided with a toothing over one portion of its edge adjacent to the pinion, and capable of occupying two positions, the passage from one position to the other occurring via a movement of rotation, and an interposed member, secured to the ring and cooperating with the push-button so that it can or cannot act on the control device.

Other features and advantages of the invention will appear from the following description, made with reference to the annexed drawing.

BRIEF DESCRIPTION OF THE DRAWINGS

FIGS. 4 to 4*d* show a device for uncoupling the "start-stop" and "reset" push-buttons, making them inoperative.

DESCRIPTION OF THE PREFERRED EMBODIMENT

Figure 1:
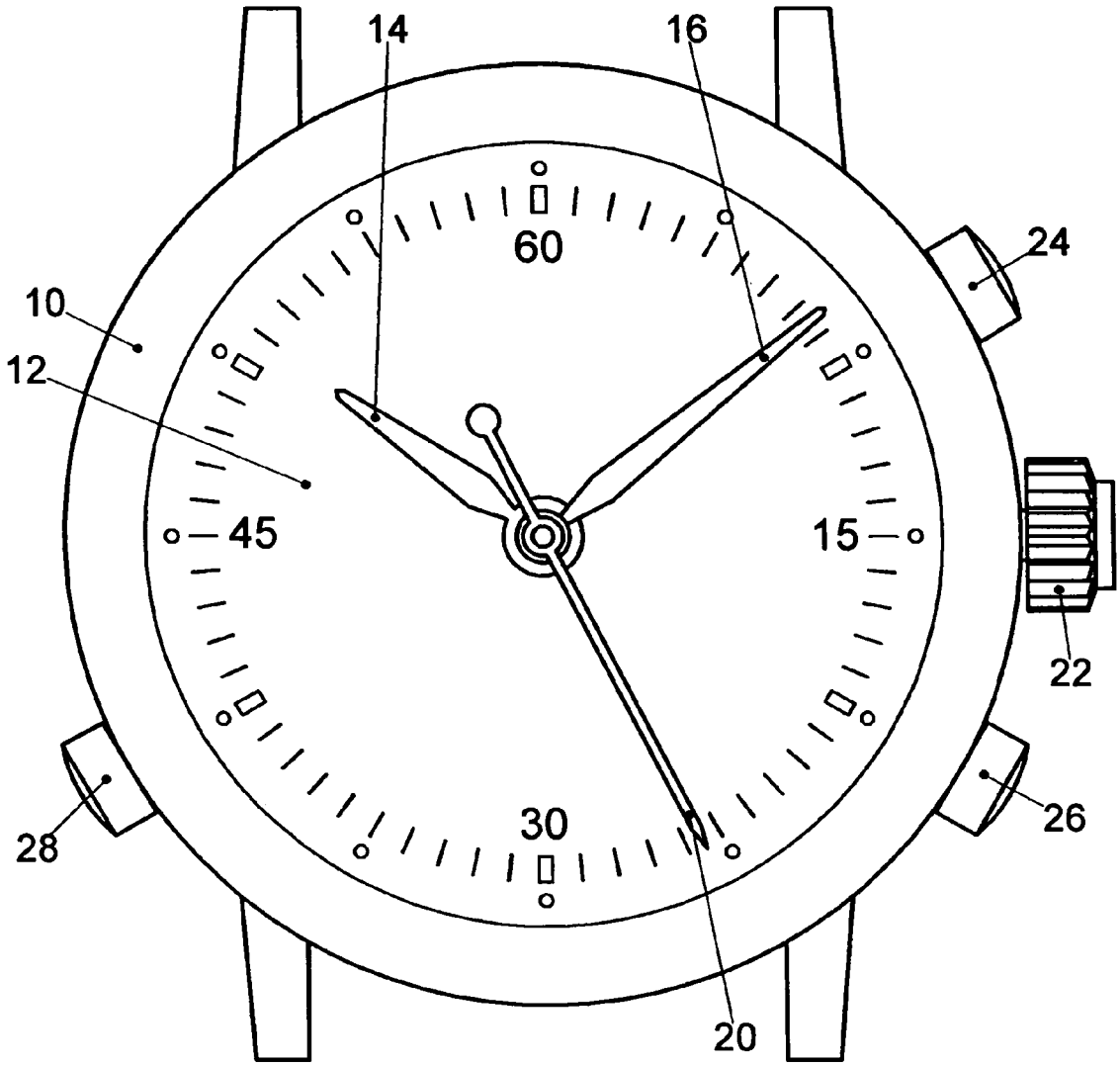
FIG. 1 shows a watch provided with a mechanism according to the invention.

The watch shown in FIG. 1 is of the chronograph type. It includes, in a conventional manner, a case 10 acting as a housing for a movement, which carries a dial 12, current time hour hand 14, current time and measured time minute hand 16 and measured time second hand 20.

Display of the current time is corrected by means of a time setting crown 22, connected to the members of the movement by a time setting stem that is not visible in the drawing.

The timing functions are carried out by three push-buttons 24, 26 and 28 respectively arranged at two o'clock, four o'clock and eight o'clock. Push-button 24 controls the starting and stopping of a measured time measurement, whereas push-button 26 resets hands 16 and 20 when a measured time measurement has been interrupted. Finally, push-button 28 allows the chronograph mechanism to pass from a first state, in which it is locked, into a second state in which it is unlocked.

When the chronograph mechanism is locked, hand 16 displays the minutes of the current time, whereas, when it is unlocked, it indicates the measured time. In the locked state, push-buttons 24 and 26 are inactive. In order to pass from one of these states to the other, the mechanism includes a locking device which will be described in more detail hereinafter and which has the effect of making push-button 24 inoperative when the mechanism is locked, whereas push-button 28 is inactive when a measurement is being made.

Figure 2A:
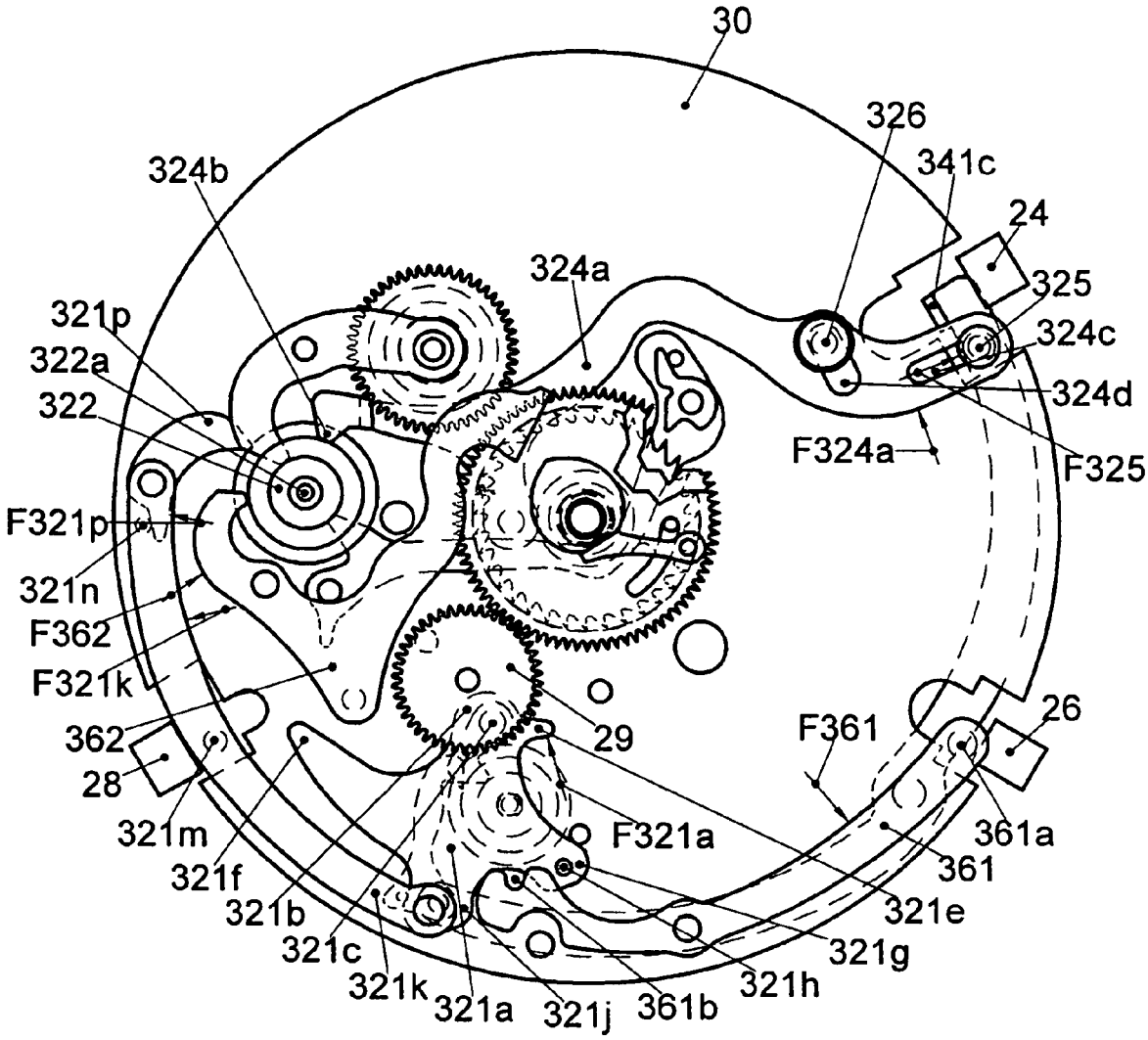
FIGS. 2*a* and 2*b* illustrate a chronograph mechanism provided with a member for locking the single "start-stop" function, fitted to the watch of FIG. 1, FIGS. 3 to 3*d* concern a device for making the "start-stop" and "reset" push-buttons inactive by locking them.

This mechanism forms part of a movement that comprises, in a conventional manner that is not visible in the drawing, an energy source, such as a barrel, a time base such as a sprung balance, a going train, of which only one mobile 29 is visible in FIG. 2*a*, and an escapement connecting the going train to the balance in order to maintain the latter, as well as time setting and chronograph mechanisms. The various components of the movement are arranged on a frame 30, formed of a plate and bridges, which assures the relative positioning of the various mobile parts.

Figure 2B:
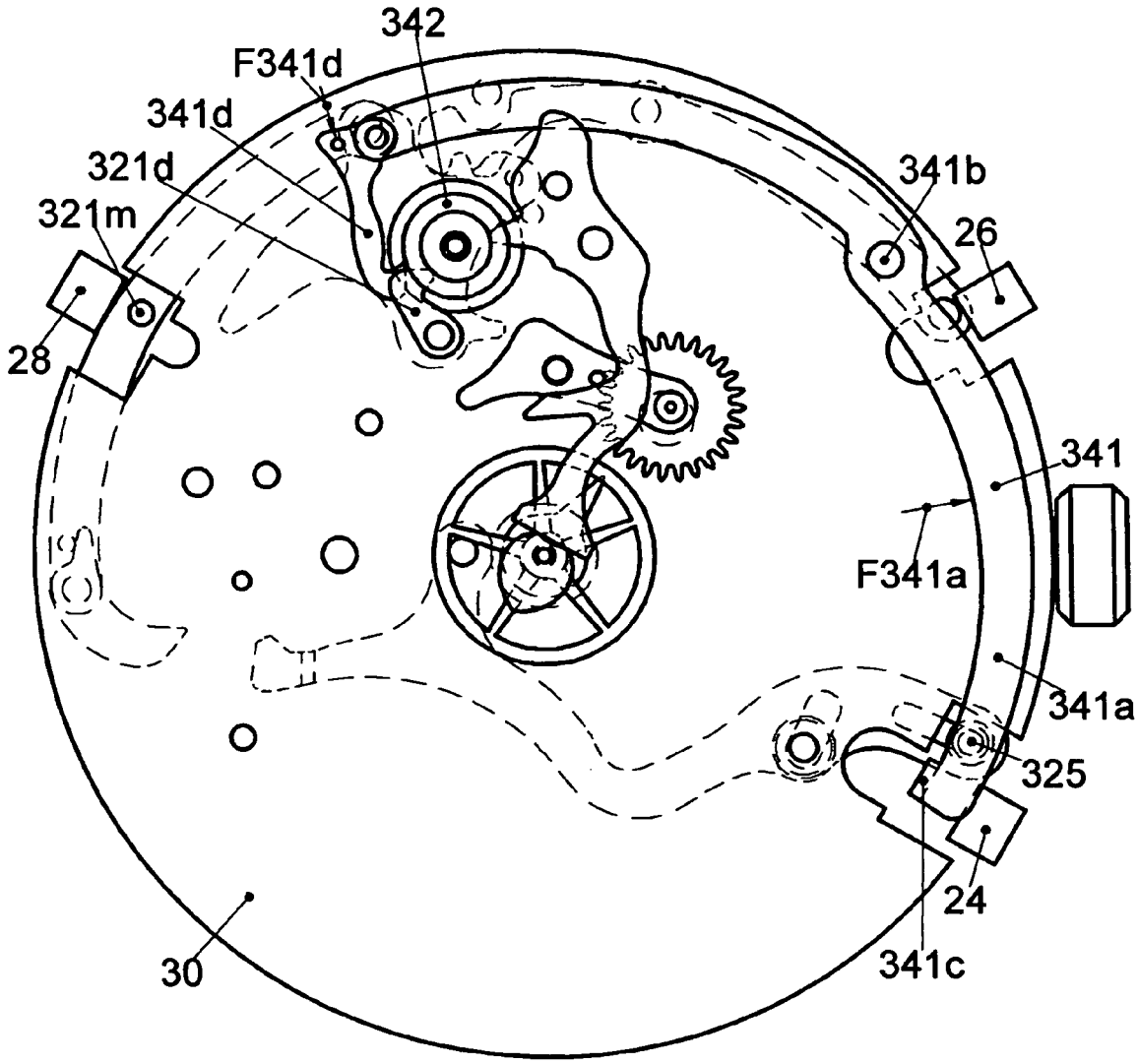

As explained hereinbefore, the chronograph mechanism shown in FIGS. 2*a* and 2*b*, which is described in more detail in EP Patent Application No. 02022505.8, displays the minutes of the measured time and of the current time with a single hand 16. The part of the mechanism relating to the "start-stop and "reset" controls could easily be replaced by any other existing chronograph mechanism.

The mechanism shown in the drawing essentially comprises locking, control and reset devices, whose component parts are identified by the first two numbers of their reference, starting respectively with 32, 34 and 36. The springs included in this mechanism are schematically represented by arrows identified by the letter "F" followed by the number corresponding to the reference of the part on which it acts. The arrow is oriented, approximately, in the direction in which the spring exerts its force.

Locking device 32 includes:

a switching member 321, comprising:

a bird-shaped body 321*a*, with a head 321*b* provided with a hole 321*c* in which there is engaged a stem passing right through frame 30 and carrying a finger 321*d* visible in FIG. 2*b*, a beak 321*e*, two wings 321*f* and 321*g*, wing 321*g* being provided with a pin 321*h*, and a tail 321*j*, head 321*b* being arranged on the centre side of the movement and tail 321*j* at the periphery, in proximity to 7 o'clock, a lever 321*k* pivotably mounted on tail 321*j* and extending over the periphery of the movement from 7 to 9 o'clock, provided with a pin 321*m* disposed so that it is or is not located on the path travelled by push-button 28, and a stop member 321*n* placed at its free end, a pawl or click 321*p* pivotably mounted on lever 321*k* and limited in its movement by stop member 321*n*, a switching cam, for example a column wheel 322, schematically shown, controlled in rotation by pawl 321*p*, rotating on frame 30 at 322*a*, an interlocking lever 324, comprising a body of elongated shape 324*a*, pivotably mounted on frame 30 in its median part, and one of whose ends is provided with a nose 324*b* arranged for cooperating with the columns of wheel 322, whereas the other end comprises a first oblong hole 324*c* in which a stud 325 is mounted to slide, for cooperating with control device 34, and a second oblong hole 324*d*, in which a pin 326 with a head is housed, itself secured to frame 30, for positioning lever 324 in the plane of the movement.

The constituent parts of locking device 32 are positioned by springs schematically represented by an arrow, and more particularly:

body 321*a* by spring F321*a*, lever 321*k* by spring F321*k* which tends to return it when pressure has been applied to push-button 28, pawl 321*p* by spring F321*p* which holds it pressed against pin 321*n*, body 324*a* by spring F324*a*, which tends to apply nose 324*b* against wheel 322, and stud 325 by spring F325, which tends to press it on the external side of oblong hole 324*c*.

Control device 34, more particularly visible in FIG. 2*b* comprises in particular:

a control lever 341 comprising:

a body 341*a* arranged at the periphery of the movement from 2 to 7 o'clock, which pivots at 341*b* on frame 30 slightly below 4 o'clock, and which is provided, at one of its ends, with a bent portion 341*c* extending into the thickness of stud 325, and a pawl 341*d*, pivotably mounted on the other end of body 341*a*, whose function will be specified hereinafter, a cam 342, for example of the column wheel type, driven by pawl 341*d*, which controls the coupling of the chronograph, not shown in the drawing, and positions switching member 321 by its finger 321*d*.

The constituent parts of control device 34 are positioned by springs and more particularly:

body 341*a*, by spring F341*a* which tends to return it when pressure has been applied to push-button 24, and pawl 341*d*, by spring F341*d*, which applies it against cam 342.

Reset device 36 is formed in particular by a lever 361 and a hammer 362.

Lever 361 is provided with a pin 361*a* arranged opposite push-button 26 and a groove 361*b* placed so that it can act as a housing for pin 321*h* when finger 321*d* is abutting against a column of cam 342. A spring F361 tends to push lever 361 back against the push-button. The hammer is also subjected to an elastic force by a spring F362 holding it pressed against wheel 322.

Hammer 362 will not be described in more detail. It is designed to cooperate with cams carried by the mobiles of the chronograph gear train carrying the hands, in order to reset them. Such devices are well known to those skilled in the art.

In the mechanism thus described, push-button 24 acts on lever 341 via stud 325, which abuts against bent portion 341*c*. Thus, when stud 325 is not inserted between bent portion 341*c* and push-button 24, an application of pressure on the latter has no effect.

When the chronograph mechanism is locked, nose 324*b* is abutting against a column of cam 322. In this position, stud 325 is drawn back from push-button 24, which is thus inactive.

If the user exerts pressure on push-button 28, the latter pushes pin 321*m*, which controls lever 321*k*. The latter drives pawl 321*p* which rotates column wheel 322.

One of the columns of wheel 322 releases nose 324*b* which falls between two columns via the effect of spring F324*a*, such that stud 325 is placed between push-button 24 and bent portion 341*c*.

Another application of pressure on push-button 28 causes column wheel 322 to rotate through one step, such that nose 324*b* is lifted up and stud 325 moves away from push-button 24, which becomes inactive again.

When push-button 24 is active, an application of pressure on the latter causes a measurement to start, in accordance with the usual operation of chronograph mechanisms and pivots lever 341 which drives pawl 341*d* and, with it, cam 342. Finger 321*d* is raised by a column of cam 342. Pin 321*h* is then engaged in housing 361*b*. Moreover, lever 321*k* is driven by body 321*a* such that pin 321*m* is shifted with respect to push-button 28. Consequently, as soon as the chronograph mechanism is started, push-button 28 becomes inactive. In this state, push-button 26 is also inactive. Of course, lever 361 pivots via the effect of an application of pressure on push-button 26, but his movement has no influence on the other parts of the mechanism.

Another application of pressure on push-button 24 stops the measurement and causes cam 342 to rotate through one step. Finger 321*d* is then between two columns of the cam. It is not fall however, despite the action of spring F321*a*, because of pin 321*h* held in housing 361*b*. Push-button 28 thus remains inactive.

If push-button 24 is again subject to an application of pressure, the measurement starts again and finger 321*d* abuts against a column.

If an application of pressure is exerted on push-button 26 when the measurement is interrupted, i.e. when finger 321*d* is between two columns of cam 342, lever 361 tips and releases pin 321*h*. Body 321*a* tips via the effect of spring F321*a*, and with it lever 321*k*. Pin 321*m* is then again opposite push-button 28 which becomes active again. The movement of body 321 also releases hammer 362 which resets the measured time minute hands to zero.

Pressing on push-button 28 causes the chronograph mechanism to return to its locked state and minute hand 16 passes from zero to displaying the current time, as was explained hereinbefore.

FIG. 3 shows a watch whose case 10, time setting crown 22 and two push buttons 24 and 26 can be seen. FIG. 3*a* also shows dial 12.

Crown 22 is used for setting information relating to the current time, push-button 24 for controlling the starting and stopping of a chronograph mechanism, and push-button 26 for resetting it. This watch is shown in FIG. 3*a* in cross-section along a plane A—A perpendicular to the drawing and in FIGS. $3b_1$ and $3b_2$ in cross-section along a plane B—B that is also perpendicular, in the locked position of push-button 24 at $3b_1$ and the released position at $3b_2$. FIGS. 3*c* and 3*d* show, seen from the side as indicated by arrows C and D, a part of the watch with the push-buttons respectively in the locked position and released position.

In these Figures, the chronograph mechanism is only shown schematically, by a portion of control lever 40 and reset lever 42, these portions respectively cooperating with push-buttons 24 and 26. This mechanism can be of any type controlled by two push-buttons.

Case 10 further carries, at 8 o'clock, a second crown 44 which, as can be seen in FIG. 3*a*, is secured to a stem 46 passing through the wall of case 10. Stem 46 is provided with a pinion 48 mounted on a square 46*a* of stem 46 and held by a screw 50 engaged in a threading made in stem 46.

The watch is also fitted with a ring 52 disposed inside case 10, adjacent to the inner wall of the middle part and to dial 12, which forms with crown 44, stem 46 and pinion 48, a device for locking push-buttons 24 and 26.

Ring 52 is provided, in its portion close to crown 44, with a sector of contrate toothing 52*a*, which meshes with the toothing of pinion 48, thus allowing it to be driven in rotation, over a limited angle. As will be explained hereinafter, ring 52 is used for locking push-buttons 24 and 26.

FIGS. $3b_1$ and $3b_2$ show push-button 24 in cross-section, engaged in case 10, respectively in the locked and free positions. A tube 54, driven into a hole in case 10, acts as a housing for push-button 24. The latter is formed of an external button 24*a*, on which the user presses, and a stem 24*b* screwed onto button 24*a* and engaged in tube 54. A sealing gasket 24*c* is housed on stem 24*b* and abuts against the inner end of button 24*a*, whereas a helical spring 55 surrounds stem 24*b* and is supported on the one hand in the bottom of tube 54, and on the other hand, against sealing gasket 24*c* returning push-button 24 when it is subject to pressure. A washer can advantageously be inserted between spring 55 and sealing gasket 24*c*.

Push-button 24 is held in case 10 by means of a screw 56 engaged in a threaded hole of stem 24*b*, which is not visible in the drawing. This screw is provided with a head 56*a*, which cooperates with lever 40 to control the chronograph mechanism. Head 56*a* has a groove 56*b* extending radially into its cylindrical portion.

In order to lock push-button 24, ring 52 comprises a cylindrical portion 52*b*, whose inner and external diameter and height are such that the portion can be engaged in groove 56*b*, as shown in FIG. 3*c*.

Portion 52*b* is provided with a rounded cut out portion 52*c*, disposed such that, when it is aligned on push-button 24, the groove is released, which makes the movement of push-button 24 possible.

When ring 52 is in one of its end positions, cut out portion 52*c* is aligned on axis B—B, such that push-button 24 can be activated. In the other position, ring 52 is engaged in groove 56*b*, thus locking push-button 24.

Push-button 26, which has the same structure as push-button 24 cooperates with ring 52 in an identical manner to the latter. A detailed description would thus add nothing further to comprehension of the device.

In an advantageous manner, the two end positions of ring 52 can be defined by a jumper spring which has not been shown in the drawing, which would have the advantage of clearly marking these two positions. Moreover, in order to allow the user to know whether or not the mechanism is operating, ring 52 is provided with a display zone 52*c* comprising two marks, for example of different colours 52*d* and 52*e*, one or other of which appears, in an aperture 12*a* of dial 12, thus showing which position ring 52 is occupying and, consequently, whether the mechanism is operating or locked.

The variant shown in FIGS. 4 to 4*d* differs from that of FIGS. 3 to 3*d* in that ring 52 does not lock push-buttons 24 and 26 but makes them active or inactive via the insertion of an elastic member. In this variant, the same parts bear the same references as in FIGS. 3 to 3*d*.

In this variant, ring 52 is made of elastic material, for example steel or beryllium bronze. It also includes a cylindrical portion 52*b*, but into which strips 52*f* are cut, secured to the cylindrical portion at one of their ends, and free and forming, by bending, a finger 52*g* at the other end. This finger 52*g* is at the same level as screw head 56*a*. Consequently, if strip 52*f* is opposite screw head 56*a*, an action on push-button 24 makes screw head 56*a* abut against strip 52*f*, finger 52*g* pushing lever 40. In proximity to bent portion 52*g*, the cylindrical portion is interrupted, such that, if the ring is rotated to bring it into the second position, the strip is no longer opposite screw head 56*a*, the movement of push-button 24 then occurring in the void.

The various embodiments described hereinbefore can be subject to numerous variants. It is thus possible to fit the locking device with means for placing gaskets 24*c* under stress, in order to reinforce the water resistance of the watch.

The function of the control member could also be performed by a time setting crown 22 in its pushed-in position, especially if the movement includes a quartz time base and an electrical energy source.

Thus, owing to the various embodiments of the device described hereinbefore, it is possible to propose chronograph-type watches offering improved operating reliability.

What is claimed is:

1. A chronograph-type watch, provided with a movement including:

current time display means, measured time display means, a time base for regulating said display means, a control device for stopping and starting the measured time display means, a reset device for returning the measured time display means to zero when a measurement is finished, and a case acting as a housing for said movement and including at least one push-button for controlling said devices, wherein said watch further includes a locking device arranged for cooperating with the control device and capable of occupying first and second positions in which said control device can or cannot be activated, and an activating member, that is accessible from outside the case, for controlling the locking device.

2. A watch according to claim 1, wherein said measured time display means further allow display of information other than the measured time and wherein said locking device is arranged so that it can only act on the control device when the measured time display means are at zero or are displaying information other than the measured time.

3. A watch according to claim 1, wherein said locking device is arranged for cooperating with the reset device to enable or disable said reset device.

4. A watch according to claim 1, wherein said locking device includes a locking part which acts on said push-button to immobilise said push-button.

5. A watch according to claim 1, wherein said locking device includes a mobile connecting part disposed such that, depending upon the position that it occupies, an application of pressure on the push-button is or is not transmitted to the control device.

6. A watch according to claim 1, wherein the locking device further includes a display member, for indicating whether or not the control device can be activated.

7. A watch according to claim 1, wherein said activating member is formed of a crown rotatably mounted on said case.

8. A watch according to claim 7, wherein the connecting member includes a stem arranged through the case and for carrying said crown at its external end, and a pinion at its end inside the case, and wherein the locking device includes:

a ring surrounding said movement and provided with a toothing on one portion of its edge adjacent to said pinion, and capable of occupying two positions, passage from one position to the other occurring by a movement of rotation, and an interposed member secured to the ring and cooperating with the push-button so that it can or cannot act upon the control device.

9. A watch according to claim 1, wherein said activating member is formed of a push-button mounted so as to slide on said case.

* * * * *